United States Patent [19]

Wright

[11] 4,245,788

[45] Jan. 20, 1981

[54] DISPENSING DEVICE FOR FLUID MATERIAL

[76] Inventor: Hershel E. Wright, P.O. Box 51, Decatur, Ill. 62525

[21] Appl. No.: 888,371

[22] Filed: Mar. 20, 1978

[51] Int. Cl.[3] ..... B05B 11/04

[52] U.S. Cl. ..... 239/327; 222/4; 222/206

[58] Field of Search ..... 239/327, 328; 222/4, 222/94, 206, 211

[56] References Cited

U.S. PATENT DOCUMENTS

| | | | |
|---|---|---|---|
| 3,176,883 | 4/1965 | Davis, Jr. | 239/327 |
| 3,189,282 | 6/1965 | Corsette | 239/327 |
| 3,367,330 | 2/1968 | Sierpin | 239/327 |
| 3,635,375 | 1/1972 | Gaetke | 222/94 |
| 3,704,811 | 12/1972 | Harden, Jr. | 222/4 |
| 3,794,247 | 2/1974 | Corsette | 239/327 |
| 4,020,979 | 5/1977 | Shay et al. | 222/211 |
| 4,093,124 | 6/1978 | Morane et al. | 239/327 |
| 4,102,476 | 7/1978 | Loeffler | 239/327 |

*Primary Examiner*—Joseph E. Valenza
*Assistant Examiner*—Michael S. Forman
*Attorney, Agent, or Firm*—Cohn, Powell & Hind

[57] ABSTRACT

This dispensing device includes a flexible container for holding fluid material said container having an end opening provided with a closure assembly and having an air bag disposed therewithin. The closure assembly includes a discharge port providing a venturi throat; a first passage system communicating between the air bag and the discharge port and a second passage system communicating between the discharge port and the interior of the container to deliver fluid material into the airstream issuing from the air bag when the container is pressurized.

7 Claims, 9 Drawing Figures

DISPENSING DEVICE FOR FLUID MATERIAL

BACKGROUND OF THE INVENTION

This invention relates generally to fluid dispensing devices and particularly to an atomizing device having an internal air bag.

Atomizing devices for fluid materials such as liquid perfumes and medicines, which break down such liquids into very small particles and spray them from the container have been known for many years. The most common form of atomizer provides an exterior air bulb by means of which a stream of air is passed over a discharge port of the container resulting in the aspiration of material from the container and dispersion of the liquid in fine particles by the air.

Although dispensing devices are known having interior containers for simultaneous discharge and mixing of different fluid materials they have most frequently been used for the dispensing of materials such as epoxy components, which are incompatible and must be kept separate until used. Only one known device having an internal container is used as a spray dispenser and this is the device disclosed in U.S. Pat. No. 3,635,375. This patent discloses a flexible outer container for fluid and an inner container for air. However, in this device the mixing process takes place in an internal mixing chamber prior to discharge resulting in incomplete atomization because of the restriction imposed by the confining effect of the mixing chamber.

The present device overcomes this and other disadvantages in a manner not disclosed in the known prior art.

SUMMARY OF THE INVENTION

This dispensing device for fluid material produces an atomized mixture of fluid and air by using an internal rather than an external air supply.

The dispensing device includes a flexible container for holding the fluid material; an air bag disposed within the container; and a closure assembly disposed in the end opening of the container, the closure assembly including a discharge port, a first passage means communicating between the air bag of the discharge port, and a second passage means communicating between the interior of the flexible container and the discharge port to deliver fluid material into the airstream issuing from the air bag when the container is pressurized.

The discharge port includes converging and diverging portions defining a venturi throat, and the second passage means communicates with the discharge port substantially at the venturi throat.

The closure assembly includes a hollow body and a cooperating insert and the first passage means includes an outer passage, formed by cooperation between the insert and the hollow body, and at least one inner passage, formed in the insert and communicating between the outer passage and the air bag. The second passage means includes an axial passage formed in the insert and communicating with the discharge port.

The first passage means includes a tubular member connecting the closure assembly to the air bag.

In one embodiment the closure assembly insert is formed in two parts, an outer part and an inner part. The second passage means includes an axial passage formed in the outer part; a transverse passage formed by cooperation between the inner and outer parts, and a passage parallel to the axial passage formed by cooperation between the insert and the hollow body, said parallel passage communicating between said transverse passage and the container interior.

This dispensing device is relatively simple in construction, easily and inexpensively manufactured and can be readily used by anyone.

DESCRIPTION OF THE PREFERRED EMBODIMENT

Figures 1, 2:
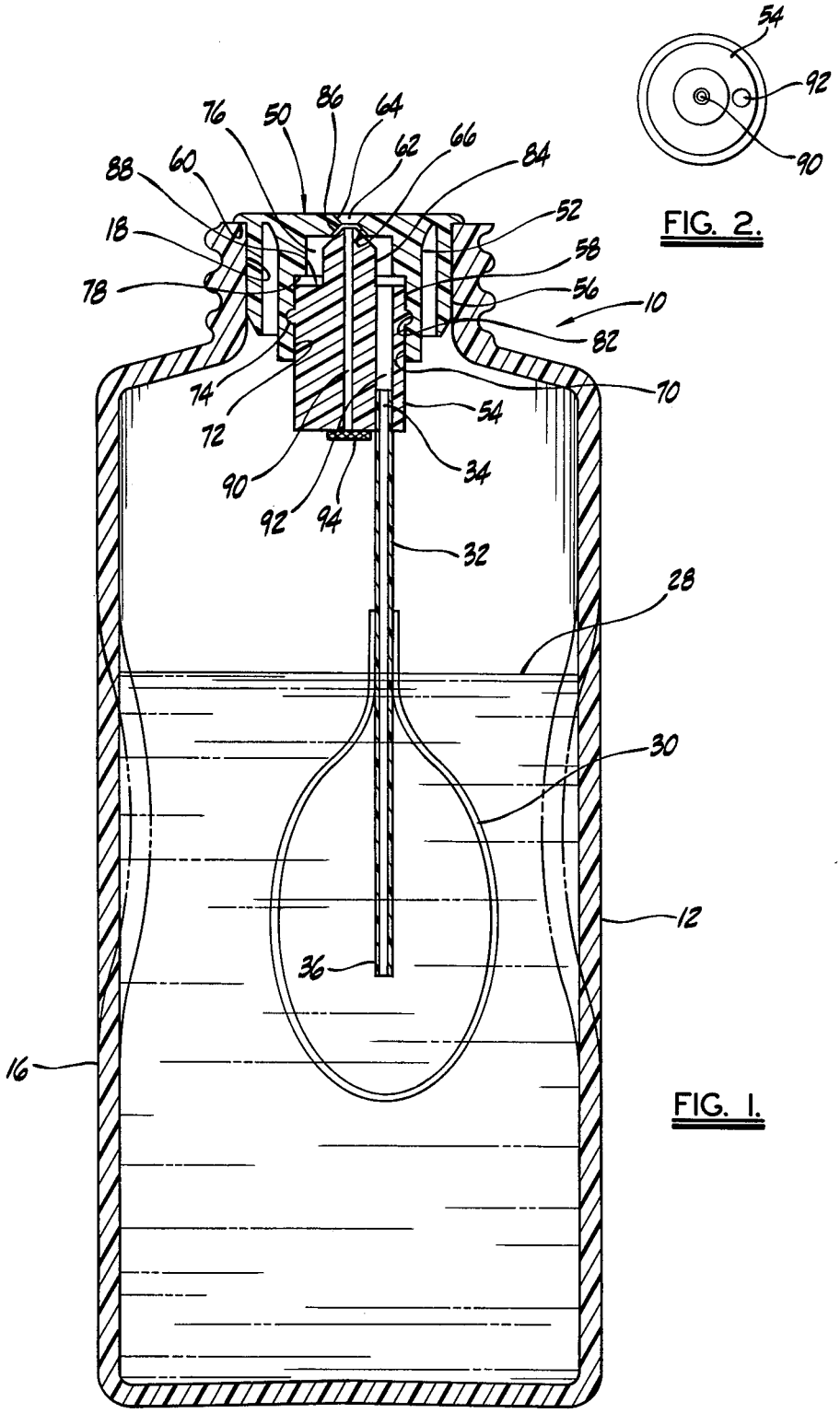
FIG. 1 is a longitudinal sectional view illustrating one embodiment of the dispensing device.
FIG. 2 is a plan view of the closure assembly insert.
Figure 3:
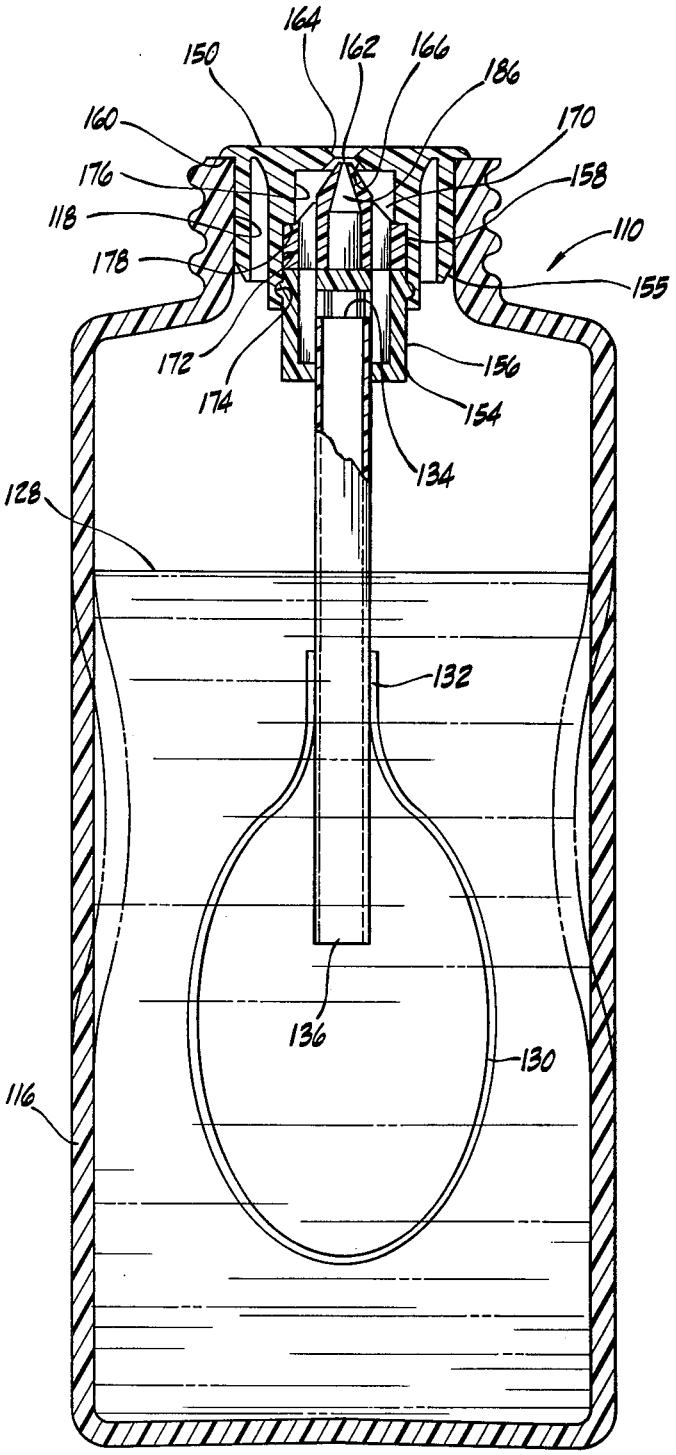
FIG. 3 is a longitudinal sectional view illustrating another embodiment of the dispensing device.
Figure 6:
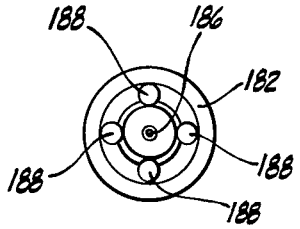
FIG. 6 is a plan view of the upper insert.

Referring now by reference numerals to the drawings and first to the embodiment disclosed in FIGS. 1 and 2, it will be understood that the dispensing device 10 includes a flexible container 12 which is used in conjunction with a closure plug assembly indicated by numeral 50 and constituting a closure means. The container 12 consists of a body portion 16, which can be squeezed by hand pressure and which will return to its original shape when the pressure is released, and an integrally formed exteriorly threaded neck portion 18. The container 12 can be provided with a closure cap (not shown) when the device 10 is not in use. An air bag 30 is disposed within the container 12 and communicates with ambience by means of a tubular member 32 and the closure assembly 50. The container 12 contains a quantity of material having fluid characteristics, such as fine powder or a low viscosity liquid, indicated by numeral 28.

The closure assembly 50 includes a body 52 and an insert 54. The body 52 includes circumferential wall 56 of a diameter to be received within the container open end defined by the container neck portion 18; a hollow inner portion 58 formed to receive the insert 54 and an annular lip 60 which is engageable with the end of the container neck portion 18. The body 52 is provided with an axially disposed discharge port 62, having upper and lower tapered margin portions 64 and 66 defining a venturi throat, and said discharge port 62 communicates with a cavity 70 formed within the body inner portion 58. The cavity 70 includes a lower portion 72 having an annular groove 74; a reduced diameter upper portion 76 and an annular shoulder 78 separating said upper and lower cavity portions. The insert 54 includes a lower portion 80 having an annular rib 82 received in snap-fitted relation within the groove 74; a reduced diameter upper portion 84 having a tapered upper end 86 and an annular shoulder 88 separating said upper and lower insert portions and being axially spaced from the cavity shoulder 78 in the operative position. The insert 54 also includes a relatively small diameter axial passage 90 communicating with the discharge port 62 at one end, and with the interior of the container body 16 at the other end, and an offset passage 92 which communicates with the discharge port 62 at its upper end by virtue of the gap provided by the spaced annular shoulder 78 and 88 and the annular space between the cavity upper portion 76 and the insert upper portion 84.

The tubular member 32 which connects the air bag 30 to the closure assembly 50 includes an upper end opening 34, communicating with the insert passage 90; and a lower end opening 36, communicating with the air bag 30, cooperates with the passage 92 and the upper cavity portion 76 to provide a first passage means between the air bag 30 and the discharge port 62. The insert axial passage 90 provides a second passage means which communicates between the interior of the container 16 and the discharge port 62 to deliver fluid material into mixing relation with the airstream issuing from the air bag 30 when the container 12 is pressurized. In practice, the insert axial passage 90 may be as small as 0.001 inches depending on the viscosity of the fluid and in some instances it may be desirable to affix a small cover 94 of porous material such as porous plastic foam over the inner end of the passage as by cementing to the adjacent body portion. The operation of the dispensing device will now be described.

The cooperation of the insert upper end 86 with the tapered lower margin portion 66 of the discharge port 62 creates a venturi effect. When the container 12 is inverted and pressure applied to the container body 16, air passing from the air bag 30 and escaping through the discharge port 62, via the tubular member 32 and the annular space between the insert 54 and the plug body portion 58, creates a venturi action which atomizes fluid being supplied under pressure through the insert axial passage 90 to mix with the air issuing from the air bag 30 and leaves the port 62 as an unconfined spray. When the pressure is relaxed, air returns through the port 62 and the tubular member 32 and inflates the air bag 30. Because of the restrictive size of the insert passage 90, air tends to inflate the air bag 30 more rapidly than it passes into the container body 16.

The foam dispensing device disclosed in FIGS. 3–9 is a modification of that shown in FIGS. 1 and 2 and it will be understood that said dispensing device 110 shown is similar to that of the embodiment disclosed in FIGS. 1 and 2 in that it includes a flexible container 112 used in conjunction with a closure plug assembly 150. Similarly, the container 112 consists of a body portion 116, which can be squeezed by hand pressure and which will return to its original shape when the pressure is released, and an integrally formed exteriorly threaded neck portion 115 and the container can be provided with a closure cap (not shown) when the device is not in use. An air bag 130 is disposed within the container 112 and is connected to a closure plug assembly 150 by means of a tubular member 132. The container 112 contains a quantity of material indicated by numeral 128 having fluid characteristics such as powder or low viscosity liquid. The closure plug assembly 150 has a different structure from that of FIGS. 1 and 2 as will now be described.

Figure 4:
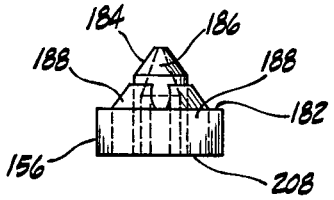
FIGS. 4 and 5 are elevational views illustrating the plug assembly upper and lower inserts respectively.
Figure 5:
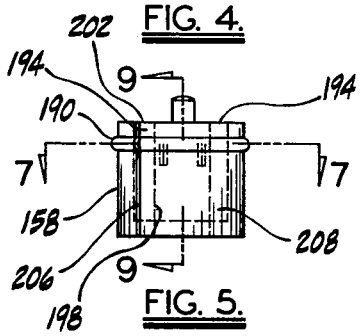
Figure 7:
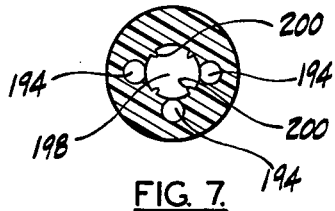
FIG. 7 is a sectional view taken on line 7—7 of FIG. 5.
Figure 8:
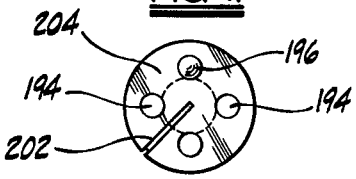
FIG. 8 is a plan view of the lower insert.
Figure 9:
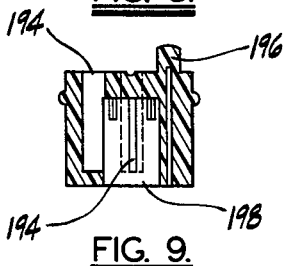
FIG. 9 is a sectional view taken on line 9—9 of FIG. 5.

The closure plug assembly 150 includes a body 152 and a two-part insert 154. The body 152 includes a circumferential wall 155 of a diameter to be received within the end opening defined by the container neck 118; a hollow inner portion 158 formed to receive the insert 154 and an annular lip 160, which is engageable with the end of the container neck 118. The body 152 is provided with an axially disposed discharge port 162, defined by upper and lower tapered margin portions 164 and 166 defining a venturi throat, and said discharge port 162 communicates with a cavity 170 formed within the body inner portion 158. The cavity 170 includes a lower portion 172 having an annular groove 174; a reduced diameter upper portion 176, and an annular shoulder 178 separating said upper and lower cavity portions. The insert 154 includes interfitting upper and lower portions 156 and 158 as best shown in FIGS. 4 and 5 respectively. The insert upper portion 156 is of a diameter to interfit the body lower cavity portion 172 and includes an annular shoulder 182 which is engageable with the annular shoulder 178 separating the upper and lower cavity portions. Said upper portion 156 also includes a tapered end 184; an axial passage 186 and a plurality of circumferentially spaced passages 188, four in number in the preferred embodiment. The insert lower portion 158 is of a diameter to be received within the lower cavity portion 172 and includes an annular rib 190 received in snap-fitted relation with the body groove 174. The lower portion 158 also includes a plurality of circumferentially spaced openings 194, three in number in the preferred embodiment and each in register with a corresponding upper portion opening 188, and a projecting element 196 which is received in interfitting relation within the remaining opening 188 and serves to align the upper and lower portions. The lower portion 158 also includes a central aperture generally indicated by numeral 198, which extends upwardly in the lower portion in intercepting relation to the openings 194, and a plurality of stop elements 200 which are circumferentially disposed about the inner end of the opening 198 as clearly shown in FIG. 7. Importantly, a relatively small diameter radially disposed channel indicated by numeral 202 is formed on the upper face 204 of the lower portion 158, and a longitudinally disposed channel 206 is formed on the cylindrical face 208, said channels being disposed in communicating relation at their point of intersection.

The tubular member 132 includes an upper end opening 134 communicating with the insert opening 198, and a lower end opening 136 communicating with the air bag 130. The stop elements 200 within the insert opening 198 limit the insertion of the upper end of said member into said opening 198. Thus, air from the air bag 130 is directed into the cut-away circumferential openings 194 when it leaves the tubular member upper end 134 because of the interception between the axial opening 198 and the circumferential openings 194. Because of the registration of openings 188 in the insert upper portion 156 with corresponding openings 194 in the insert lower portion 158, air is directed through said openings 188 and into the upper cavity 176 and through the discharge port 162. In this manner the tubular member 132 cooperates with the insert openings 198, 194 and 188 and the upper cavity portion 176 to provide a first passage means between the air bag 130 and the discharge port 162. The interior of the container body 116 communicates with ambience by way of the longitudinal and radial channels 206 and 202 provided in the insert lower portion 156 and the central axial opening 186 provided in the insert upper portion 158 which communicates with the radial channel 202 when the insert portions are interfitted.

It will be understood that when the interfitted insert portions are in place within the cavity 170, the longitudinal channel 206 cooperates with the side wall of the lower cavity portion 172 to form a longitudinal passage and the radial channel 202 cooperates with underface 208 of the insert upper portion 156 to form a radial passage communicating with said longitudinal passage at the outer end and with the insert opening 186 at the other end, said passages and said opening providing a second passage means.

The operation of the dispensing device will now be described. The cooperation of the insert tapered end 184 with the tapered lower margin portion 166 of the discharge port 162 creates a venturi effect. When the container 112 is inverted and pressure applied to the container body 116, air passing from the air bag 130 and escaping through the discharge port 162, via the tubular member 132 and the registered passages 194 and 188, creates a venturi action which atomizes liquid being supplied under pressure through the passages 206, 202 and 186 into mixing relation with the airstream from the air bag 130 to leave port 62 as an unconfined spray. When the pressure is released, air returns through the port 162, openings 188 and 194 and the tubular member 132 and inflates the air bag 130. Because of the restrictive size of the insert passages 206, 202 and 186, air tends to inflate the air bag 130 more rapidly than it passes into the container body 116.

Both of the above foam dispensers have been described as being operated in an inverted condition. However, the structural arrangement of parts provides a venturi action which is sufficiently effecient that the devices are not limited to use in an inverted condition but may also be operated in other positions, including a vertical position which facilitates a more general use of these dispensing devices.

I claim as my invention:

1. A dispensing device for a fluid material comprising:
(a) a flexible container for holding the fluid material, said container having an end opening,
(b) an air bag means disposed within the container,
(c) a closure means disposed in said end opening and including:
1. a discharge port defined by substantially fixed inner and outer margins,
2. a first passage means operatively communicating between the air bag means and the discharge port, said discharge port providing a reduced cross sectional area between said first passage means and ambience, and
3. a second passage means communicating between the interior of the container and the discharge port between the inner and outer margins of the discharge port to deliver fluid material into the airstream issuing from the air bag means when the container is pressurized.

2. A dispensing device as defined in claim 1, in which:
(d) the discharge port inner and outer margins define converging and diverging portions respectively defining a fixed venturi throat, and
(e) said second passage means communicates with said discharge port substantially at said venturi throat.

3. A dispensing device as defined in claim 1, in which:
(d) the first passage means includes a separate tubular member connecting said closure means to said air bag means.

4. A dispensing device for a fluid material comprising:
(a) a flexible container for holding the fluid material, said container having an end opening,
(b) an air bag means disposed within the container,
(c) a closure means disposed in said end opening and including:
(1) a discharge port,
(2) a first passage means operatively communicating between the air bag means and the discharge port, said discharge port providing a reduced cross sectional area between said first passage means and ambience, and
(3) a second passage means communicating between the interior of the container and the discharge port to deliver fluid material into the airstream issuing from the air bag means when the container is pressurized,
(d) said closure means including:
(1) a hollow body means providing said discharge port, and
(2) a cooperating insert means received by said hollow body means,
(e) said first passage means including:
(1) an outer longitudinal passage formed by cooperation between said insert means and said hollow body means and communicating with said discharge port, and
(2) at least one inner longitudinal passage formed in said insert means and communicating with said outer longitudinal passage and said air bag means, and
(f) said second passage means including an axial passage formed in said insert means and communicating with said discharge port.

5. A dispensing device for a fluid material comprising:
(a) a flexible container for holding the fluid material, said container having an end opening,
(b) an air bag means disposed within the container,
(c) a closure means disposed in said end opening and including:
(1) a discharge port,
(2) a first passage means operatively communicating between the air bag means and the discharge port, said discharge port providing a reduced cross sectional area between said first passage means and ambience, and
(3) a second passage means communicating between the interior of the container and the discharge port to deliver fluid material into the airstream issuing from the air bag means when the container is pressurized,
(d) said closure means including:
(1) a hollow body means providing said discharge port, said discharge port having converging and diverging portions defining a venturi throat,
(2) a cooperating insert means received by said hollow body means, said insert having interengageable inner and outer parts,
(e) said first passage means including
(1) an outer longitudinal passage formed by cooperation between said insert means and said hollow body means and communicating with said discharge port, and
(2) a plurality of longitudinal passages formed in said insert means and communicating with said discharge port, and
(f) said second passage means including:
(1) an axial passage formed in said outer part of said insert means and communicating with said discharge port substantially at said venturi throat, and (2) a transverse passage formed by cooperation between the inner and outer parts of the insert means, and communicating with said axial passage.

6. A dispensing device for a fluid material comprising:

(a) a flexible container for holding the fluid material, said container having an end opening, (b) an air bag means disposed within the container, (c) a closure means disposed in said end opening and including:

(1) a discharge port, (2) a first passage means operatively communicating between the air bag means and the discharge port, said discharge port providing a reduced cross sectional area between said first passage means and ambience, and (3) a second passage means communicating between the interior of the container and the discharge port to deliver fluid material into the airstream issuing from the air bag means when the container is pressurized, (d) said closure means including:

(1) a hollow body means providing said discharge port, said discharge port having converging and diverging portions defining a venturi throat, and an outer cavity, and (2) a cooperating insert means received by said hollow body means said insert means having interengageable inner and outer parts said outer part including a converging portion, disposed in spaced relation to said converging portion of said discharge port, (e) said first passage means including:

(1) an outer longitudinal passage formed by cooperation between said cavity and said insert means and communicating with said discharge port, (2) a plurality of longitudinal passages formed in said insert means, and communicating with said outer longitudinal passage, (3) an axial passage communicating with said longitudinal passage, and (4) a tubular member connecting said axial passage to said air bag means, (f) said second passage means including:

(1) an axial passage formed in said insert outer part and extending through said converging portion to communicate with said discharge port substantially at said venturi throat, (2) a transverse passage formed by cooperation between the inner and outer parts of the insert means and communicating with said axial passage, and (3) a passage parallel to said axial passage formed by cooperation between said inner part of said insert means and said body means said parallel passage communicating with said transverse passage and said container interior.

7. A dispensing device for a fluid material comprising:

(a) a flexible container for holding the fluid material said container having a discharge port defined by substantially fixed inner and outer margins, (b) an air bag means disposed within the container, and (c) means for mixing the fluid material and air from the air bag means including:

1. a first passage means communicating between the air bag means and the discharge port, said discharge port providing a reduced cross sectional area between said first passage means and ambience, and 2. a second passage means communicating between the interior of the container and the discharge port between said inner and outer margins of the discharge port to deliver fluid material into the airstream issuing from the air bag means when the container is pressurized.

* * * * *